US008214971B2

(12) United States Patent
Carter et al.

(10) Patent No.: US 8,214,971 B2
(45) Date of Patent: Jul. 10, 2012

(54) DOOR EQUALIZER SUPPORT AND HANDHOLD

(75) Inventors: Edward V. Carter, Edwardsville, IL (US); Charles Hull, Alhambra, IL (US)

(73) Assignee: DRS Sustainment Systems, Inc., St. Louis, MI (US)

( * ) Notice: Subject to any disclaimer, the term of this patent is extended or adjusted under 35 U.S.C. 154(b) by 313 days.

(21) Appl. No.: 11/936,248

(22) Filed: Nov. 7, 2007

(65) Prior Publication Data

US 2008/0189907 A1 Aug. 14, 2008

Related U.S. Application Data

(60) Provisional application No. 60/864,664, filed on Nov. 7, 2006, provisional application No. 60/889,600, filed on Feb. 13, 2007.

(51) Int. Cl.
*E05F 3/02* (2006.01)

(52) U.S. Cl. ..... 16/66; 16/49; 16/71; 292/262

(58) Field of Classification Search ..... 16/66, 67, 16/68, 65, 49, 71, DIG. 17, DIG. 41; 292/259 R, 292/262, 263

See application file for complete search history.

(56) References Cited

U.S. PATENT DOCUMENTS 1,646,039 A * 10/1927 Murton ..... 173/126
2,098,146 A * 11/1937 Hunt ..... 173/126
3,082,472 A 3/1963 Roquemore
RE27,714 E 7/1973 Waldo
4,701,142 A * 10/1987 Merritt ..... 16/426
4,777,698 A * 10/1988 Lord ..... 16/66
4,813,100 A * 3/1989 King ..... 16/49
5,575,513 A * 11/1996 Tuttle ..... 292/339
6,748,624 B1 * 6/2004 Aderholt ..... 16/82
2002/0066229 A1 * 6/2002 Rubio ..... 16/66

OTHER PUBLICATIONS

International Search Report dated Jul. 28, 2008 for International Application No. PCT/US/07/83883.

* cited by examiner

*Primary Examiner* — Victor Batson
*Assistant Examiner* — Jeffrey O Brien
(74) *Attorney, Agent, or Firm* — Kilpatrick Townsend & Stockton LLP

(57) ABSTRACT

A pneumatic door closer with a protective external telescoping cylinder and angled handhold. Such a closer is generally outfitted with a structural tubular support that follows the telescoping and collapsing of the closer's piston and that has sufficient stiffness to limit the stresses imposed on the piston throughout its extension. The support provides a resistance to perpendicular force. Moreover, when the piston is collapsed within the exterior chamber, the support pivots to the exterior chamber with bushing(s) fixed to the end of the support that travel along the length of the exterior column as the closer telescopes or collapses, to permit continued smooth sliding motion throughout the extension stroke.

16 Claims, 6 Drawing Sheets

DOOR EQUALIZER SUPPORT AND HANDHOLD

CROSS REFERENCE TO RELATED APPLICATION(S)

This application claims benefit of and priority to U.S. Provisional Application Ser. No. 60/864,664, filed Nov. 7, 2006 and U.S. Provisional Application Ser. No. 60/889,600, filed Feb. 13, 2007. The entire disclosure of both documents is herein incorporated by reference.

BACKGROUND

1. Field of the Invention

This disclosure relates to the field of pneumatic door closers. In particular, to pneumatic door closers which have a protective external telescopic extension cylinder and an ergonomic handhold for directing perpendicular pressure and facilitating door closure.

2. Description of the Related Art

Pneumatic devices, which convert air (most commonly compressed nitrogen) into mechanical motion via an actuator, are used in industrial applications where less force than hydraulic systems and less cost than electric systems are desired. Applications include dentistry drills, jackhammer's, barostats, and the movement of objects in a large range of sizes, from powders to pellets to mail to railway passenger cars. The most common applications are automotive hatchbacks, trunk lids, and hoods.

Pneumatic devices for the closure and opening of doors, and for the equalizing of force in opposition of gravity, are utilized whenever users desire or require assistance in operating the door. This can be because the user is weak or incapacitated, as in handicapped access doors; because the door is too light and users wish to prevent it from banging against the doorframe, as in screen doors, or because the door is too heavy or of an awkward shape, as in industrial garage doors and helicopter doors. Doors in armored vehicles are particularly good candidates for a pneumatic device, as the doors are made of heavy gauge steel and plated with heavy armor panels. The doors are simply too heavy for a soldier to close without mechanical assistance. Moreover, the soldiers are often in too urgent of a hurry to waste time and energy moving the door entirely by their own unassisted force.

While pneumatic equalizers are necessary to assist soldiers in closing the doors on armored vehicles, they present four problems. Firstly, the equalizer has traditionally been positioned such that it blocks ingress and egress from the vehicle. Early equalizers required bulky machinery, for example including a series of torsion bars, a crank lever, a cam roller, and a rocker arm, which occupied significant floor space. While pneumatic equalizers improved on this situation, even the more streamlined and less bulky pneumatic equalizers remain positioned such that, when the vehicle door is open, they extend through the entire vertical height of the doorway and impede ingress and egress through the doorway.

Secondly, users desiring to close doors outfitted with current equalizers must do so from within the unprotected doorway, beyond the space protected by the vehicle's sides. Thus, in order to close the door to protect the passengers from a threat, a soldier must expose himself to that threat. It is desirable that users be able to close armored vehicle doors while still substantially protected by the vehicle body.

A third problem with current armored vehicle pneumatic door closers is that users must manipulate the entire and substantial weight of the door directly against the force of gravity. This is particularly problematic for closers of armored vehicle doors, as the doors are extremely heavy and the users are often in an emergency. While pneumatic closers help to equalize that force, the substantially vertical alignment of the closer still requires soldiers desiring to close the heavy door must pull it in direct opposition to the force of gravity. In a combat situation, in which users may be fatigued by combat or harsh living conditions or in an emergency, this great exertion of force required to protect passengers is unacceptable. It is desirable that users be required to exert less force to close armored vehicle hatches.

A final problem with pneumatic door closers is their inability to withstand pressure applied perpendicularly to their long axis. Pneumatic devices are designed with a very small diameter in order to create efficient tension and compression loading along the axis of the cylinder. However, this efficient design provides no support for pressure applied perpendicular to that axis. When faced with perpendicular pressure, the exterior column warps in the direction of the force's application. The problem occurs once the pressure is released; at that point, the exterior column does not completely flex back to its original orientation. When the exterior column remains bent, it engages more frictionally with the interior column, which decreases the column's ability to telescope and collapse as the door opens and closes.

Depending on their placement and use, some pneumatic door closers are more at risk of applied perpendicular pressure. Door closers that project into or extend throughout a doorway are prime targets for this pressure, as the door's user will be tempted to grasp the columnar closer unit for stabilization en route through the doorway. Closers for doors used by hurried users are more likely to receive more pressure; quickly moving users not only are more likely to grasp the closer for stabilization or to "swing on," but also their accelerated movement creates more perpendicular pressure than more leisurely users that is then transferred to the closer. It is precisely where users are in a hurry, however, that moving parts must function well, users are presumably in a hurry for a reason, and that reason is thwarted when the door fails to operate because of a damaged door closer. Users of armored vehicles are often in a hurry for the most essential of reasons: the preservation of human life. When such a user enters an armored vehicle in order to leave an emergency situation, that user will most likely swing on the closer and apply great perpendicular force; paradoxically, that user is also relying on the closer to function properly so that the vehicle can quickly move him or her away from danger. It is therefore desirable that armored vehicle closers be able to resist the inevitable, substantial, and frequent perpendicular pressure applied to them by users as they pass through the doorway.

To address the problem of perpendicular pressure, many pneumatic door closers are outfitted with springs to relieve the column of the perpendicular pressure by absorbing and dispersing it. These springs may be internal or external to the column; internal springs are often lubricated to prevent the springs friction with the column from interrupting the closer's performance. In the context of armored vehicle door closers, however, these springs have proven insufficient given the heavy weight of the door and frequent, substantial perpendicular pressure applied to the closer given the haste with which users often enter and exit the doorway. In the context of armored vehicles, door closer failure due to a bent exterior column is particularly problematic given the urgency with which the door must often be closed.

Another solution to the problem of perpendicular force applied by passing users is the ubiquitous "no hands" notice. This image of a hand inside a struck-through red circle is meant to prevent users from grasping the door closer. This signage has many limitations. First, the notice's size is limited by the narrowness of the cylindrical door closer. It is unlikely that soldiers urgently entering or leaving an armored vehicle will see or mind any small sign. Some closers may not afford any room at all for a notice. Finally, it is unlikely that hurried users will heed instructions not to grasp an object that can stabilize them during their ingress or egress. As springs and notices have both failed to protect door closers from failure caused by perpendicular pressure, it remains desirable that armored vehicle door closers be able to withstand such pressure.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

To address the problems of closers blocking ingress and egress, the excessive vertical force required to close an armored vehicle door, the exposure of users to hazards outside the vehicle, and closer disrepair after the application of perpendicular force, as well as other problems in the art, disclosed herein, among other things, is a pneumatic door closer with a protective external telescoping cylinder and angled handhold. This is generally referred to as a "door equalizer support and handhold." The embodiment herein is outfitted with a structural tubular support that follows the telescoping and collapsing of the closer's piston and that has sufficient stiffness to limit the stresses imposed on the piston throughout its extension. The support provides a resistance to perpendicular force. Moreover, when the piston is collapsed within the exterior chamber, the support pivots to the exterior chamber with bushing(s) fixed to the end of the support that travel along the length of the exterior column as the closer telescopes or collapses, to permit continued smooth sliding motion throughout the extension stroke. Thus, the addition of the structural tubular support and bushings prevents elastic deformation of the actuator components, while maintaining a smooth stroke as the column telescopes and collapses.

Described herein, among other things, is a pneumatic door closer comprising: a door mounted to a doorframe; an extendable and retractable pneumatically-powered actuator of generally conventional construction, comprising a piston and an exterior chamber, the actuator being attached to the door and doorframe such that extension and retraction of the actuator contributes to the swinging movement of the door, and such that points of attachment to the door and doorframe delineate a plane having a substantial horizontal component; a structural tubular support that pivots on the first end of the piston such that the support shields the piston throughout the extension and retraction; the support also piloting to the chamber with bushing fixed to the support such that when the piston is disposed within the chamber, the bushing engages with an external surface of the chamber with minimal friction; and a handlebar comprising a first end spacing portion, a second end spacing portion, and a grasping portion therebetween, durably mounted by the spacing portions to the support adjacent to the point at which the support pivots on the first end of the piston, at an angle projecting from the plane such that force applied perpendicular to the grasping portion is translated into force along the plane.

Those with ordinary skill in the art will understand that pneumatic cylinders are a very common type of pneumatic actuator, but that the cylindrical shape is not essential to operation of the actuator. Thus, terms "pneumatic cylinder" and "pneumatic actuator" as used in this specification are intended to encompass any pneumatic device that operates in substantially the same way as disclosed herein, whether cylindrical or not.

DESCRIPTION OF THE PREFERRED EMBODIMENT(S)

The following detailed description illustrates by way of example and not by way of limitation.

Figure 1:
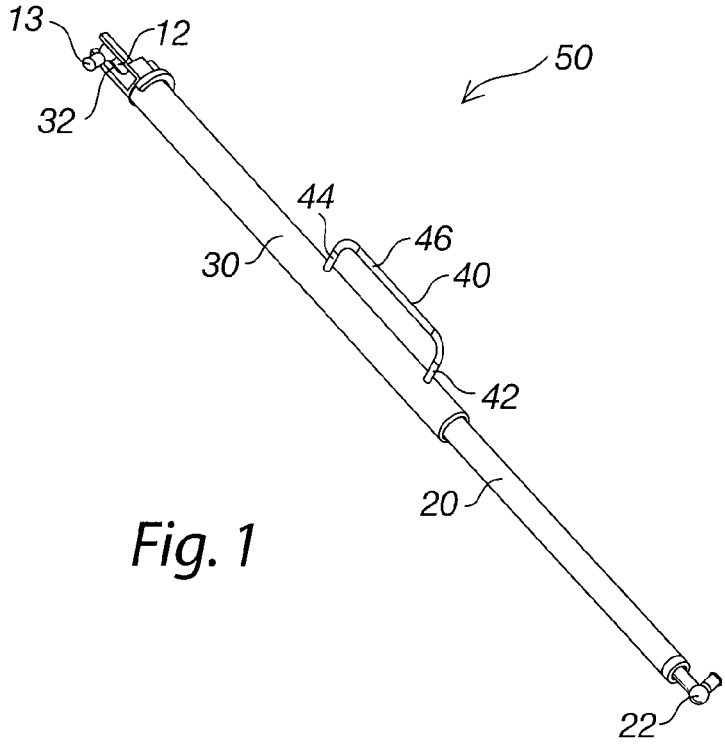
FIG. 1 shows an embodiment of a door equalizer support and handhold with the actuator substantially telescoped.
Figure 2:
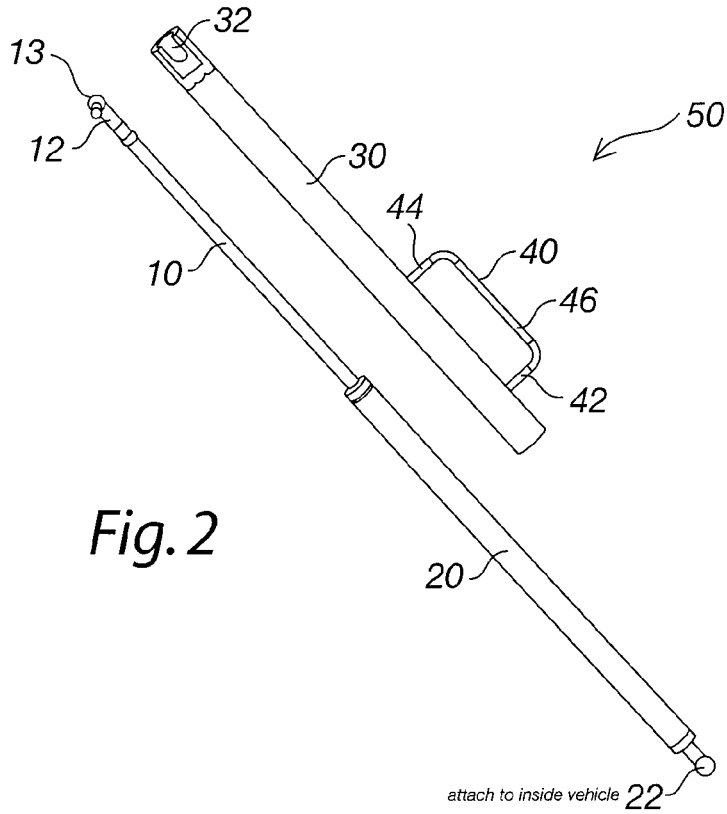
FIG. 2 shows an embodiment of a door equalizer support and handhold with the support and handhold detached from the actuator.

FIGS. 1 and 2 show an embodiment of the pneumatic door equalizer support and handhold (50) with the piston (10) fully withdrawn, in a telescoping manner, from the exterior chamber (20). In an embodiment, the air in the pneumatic equalizer is compressed nitrogen, although the air may consist of any component known in the art. An embodiment of the handlebar (40), attached to a structural tubular support (30), has two end spacing portions (44) and (42) and a grasping portion (46) therebetween. The spacing portions (44) and (42) are of such a length as to provide enough room between the grasping portion (46) and the support (30) for users to easily grasp the grasping portion (46).

FIG. 2 shows an embodiment of the pneumatic door equalizer support and handhold (50) disassembled to show the relationship in that embodiment between the piston (10), support (30), and exterior chamber (20). The support (30) has, on the end opposite the junction with the exterior chamber (20), a circumferential groove (32) that pivots to a cylinder (12). The cylinder (12) is shaped to fit into the circumferential groove (32), and is located between the piston (10) and the point of attachment to the vehicle (13). The groove (32) pivots on the cylinder (12) such that the support (30) is positioned axial with the piston (10) throughout any telescoping of the piston (10) from the exterior chamber (20). The continuous axial positioning of the support (30) with the piston (10) provides the piston (10) with uninterrupted protection from horizontal pressure. While the embodiment utilizes the complementary shapes of a circumferential groove and cylinder, any other means of so positioning the support (30) with the piston (10) known by those with expertise in the art is contemplated. The support (30) is of sufficient stiffness to absorb horizontal pressure such that distorting pressure is not transferred to the piston (10) or chamber (30).

Figure 3A:
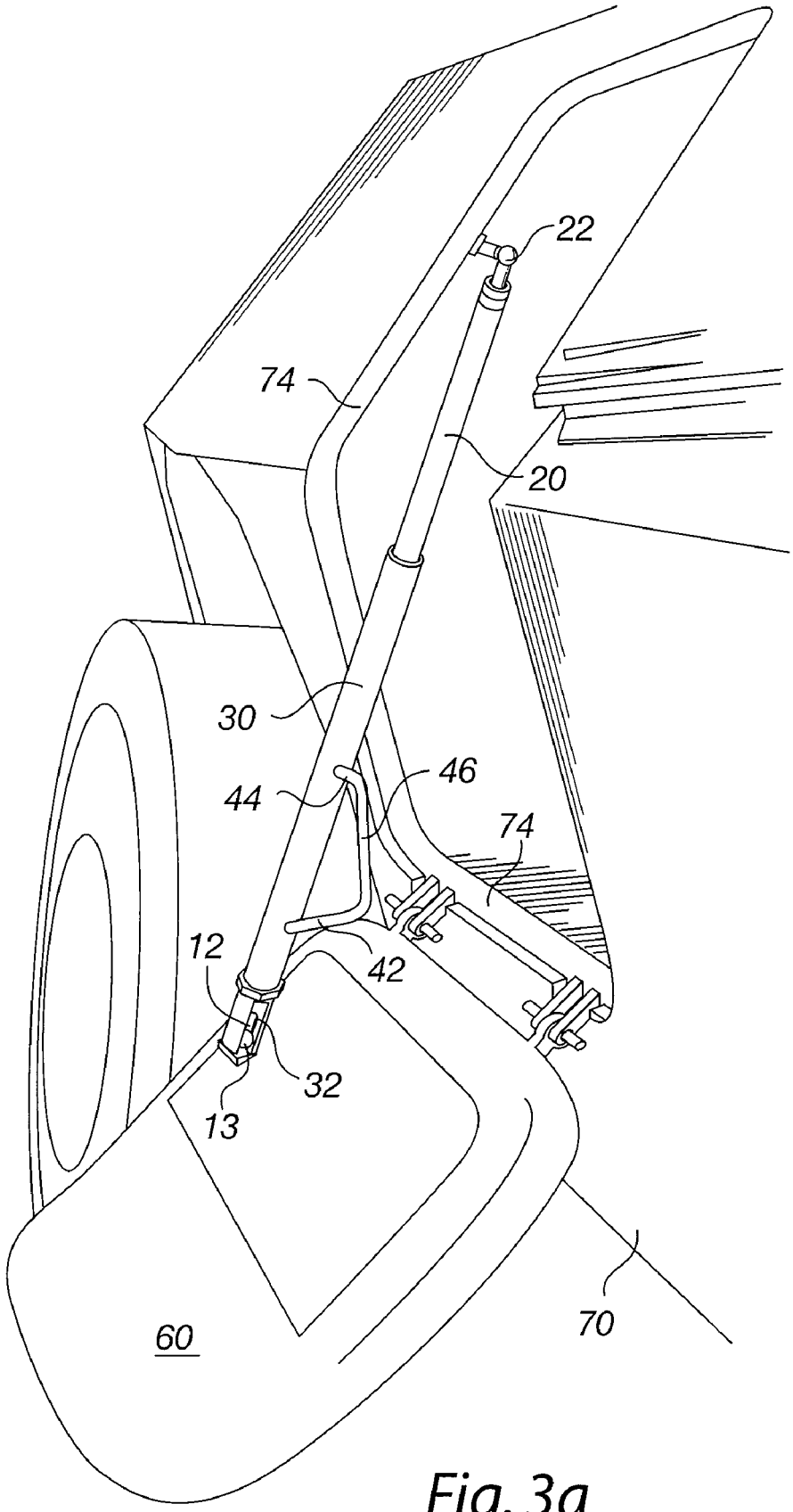
FIG. 3 shows various views of an embodiment of a door equalizer support and handhold as affixed to a vehicle and door with the door in the open position and the actuator as substantially telescoped.
Figure 3B:
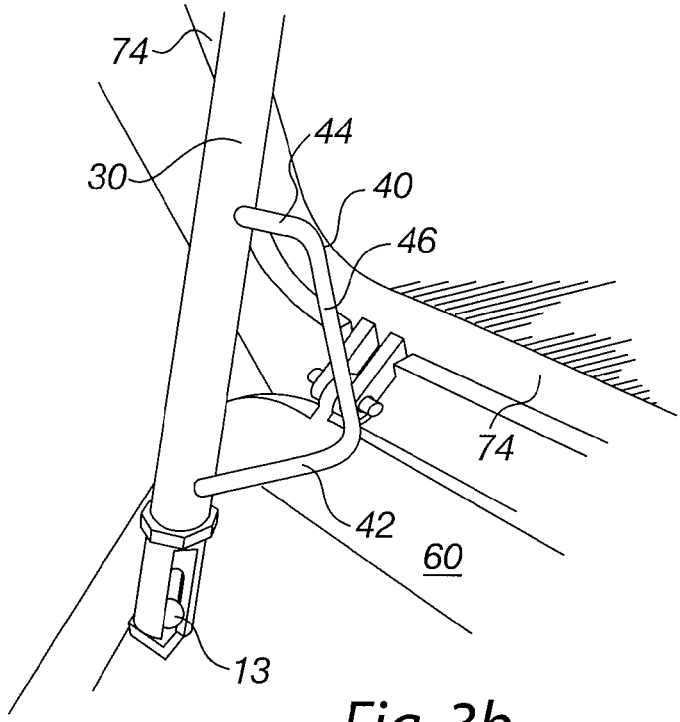
Figure 3C:
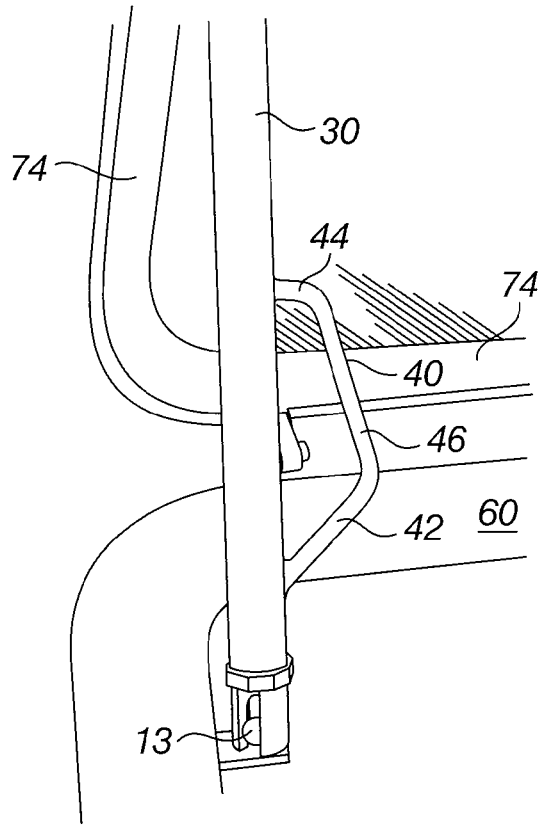

FIG. 3 shows an embodiment of the door equalizer support and handhold (50) attached to a vehicle (70) in the fully telescoped position. In an embodiment, two or more equalizers may be installed, in order to alleviate the door's great weight, especially if the door has a great deal of armor on it. In such an embodiment, for example, there may be one equalizer on either side of a heavily armored door. The positioning of the handlebar (40) provides users with an ergonomic location for stabilizing their movement that does not place damaging horizontal stress on the equalizer (50). The handlebar (40), which projects into the doorway and is stably affixed to the support, is ergonomically positioned so that users seeking stabilization during ingress and egress will prefer to grasp the handlebar (40) rather than any other, more fragile part of the equalizer (50). This both facilitates user ingress and egress, and protects the equalizer (50). Moreover, the handlebar (40) and support (30) are designed to absorb the horizontal force caused by the user's "swinging on" the handlebar (40) so that the equalizer (50) is not distorted by that force This is achieved by the structural unity and stiffness of the handlebar (40) and support (30). With these improvements, the application of a force perpendicular to the axis of the equalizer, regardless of position along its axis, is reacted by a couple, resistance to moment force, through the equalizer body. Previous equalizers were too often inappropriately used to stabilize users, and as they did not have a support (30) or handlebar (40), were subjected to damaging horizontal force which destroyed the slideability of the piston within the exterior chamber.

In addition to being an ergonomic, structurally sound source of user stabilization, the handlebar (40) can be used to close the door (60) by a user remaining protected within the vehicle (70). The embodiment shown accomplishes this by the position of the equalizer (50) substantially adjacent to the door frame (74), the position of the handlebar (40) near the lower edge of the doorframe (74) when the door (60) is open, and the angle at which the handlebar (40) projects from the circumference of the equalizer (50) towards the interior of the vehicle (70) When the door (60) is open, the handhold (40) is at the level of the vehicle floor, immediately within the doorframe, users may reach the handhold (40) while remaining within the vehicle's protected interior. Moreover, the handhold (40) is angled relative to the equalizer (50) such that a pulling force applied by a user so positioned efficiently collapses the equalizer (50). In an embodiment, show in FIG. 5, two handlebars (41), (45) are present, serving specific functions of stabilization and closure, respectively.

In addition, in an embodiment, the handhold's presence and positioning permits closure of the door by a user still protected by the armored vehicle. In an embodiment of a vehicle with a door that swings in a direction other than downward to open, the handlebar would be located near the edge of the doorframe hosting the hinge. Because of these attributes, the users do not need to expose themselves to grasp the handlebar (40) and so close the door (60). Previous door closers required users to enter the doorway and expose themselves to threats to manipulate the equalizer and door.

The equalizer (50) is attached to the vehicle door (60) at the piston terminus (13) and to the vehicle's interior (72) at the exterior chamber terminus (22) such that the equalizer (50) is substantially adjacent to the door frame (74). These attachment points are substantially equivalent to prior attachment points, providing for easy retrofit onto vehicles equipped with earlier pneumatic equalizers.

The addition of the handlebar (40) does not destroy the equalizer's (50) unobtrusiveness, as its design allows it to be tucked into the side of the doorway. In an embodiment, this is achieved by the top spacing portion (42) being shorter than the bottom spacing portion (44).

Additional improvement is achieved by the substantial horizontal component in the angle formed between the two teimini (13) (22) when attached to the vehicle (70). This embodiment is positioned at more of an angle than closers in the current art, so that the door (60) may be closed via the application of force more perpendicular to gravity and so less exhausting to users. Rather than extending in a substantially vertical fashion from a point of attachment on the interior of the vehicle (70) to a point of attachment on the door (60), and requiring force to be exerted directly against gravity, the equalizer (50) is positioned such that the plane defined by the closer's two points of attachment has a substantial horizontal component relative to the vertical height of the doorway. In an embodiment, this improvement is supplemented by the presence of two or more equalizers (50); each additional employed equalizer lessens the force that must be applied to each equalizer if all are used simultaneously.

Figure 4A:
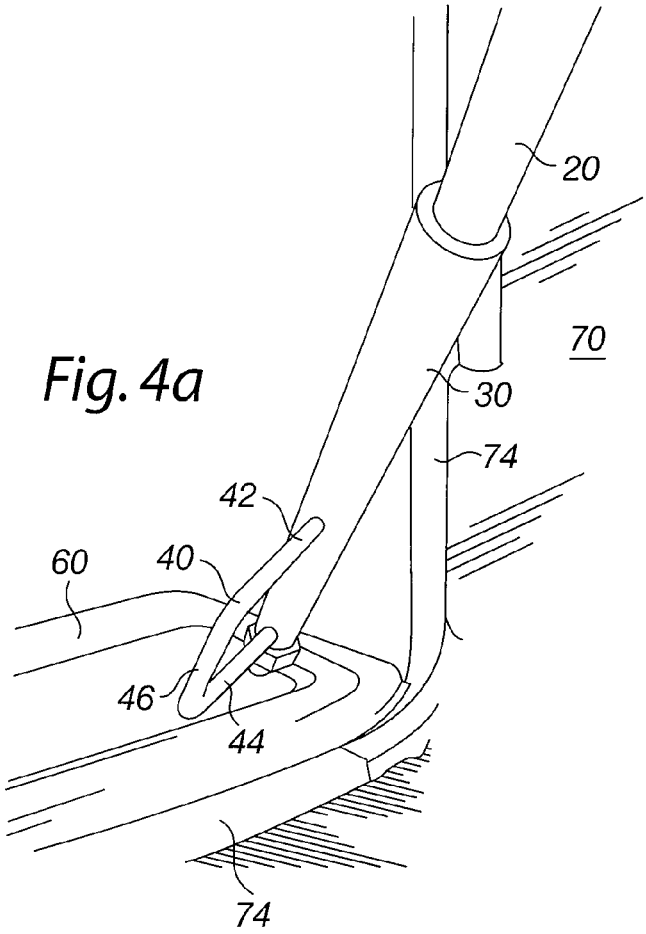
FIG. 4 shows two views of an embodiment of the actuator and handhold positioned for effective and safe door closure.
Figure 4B:
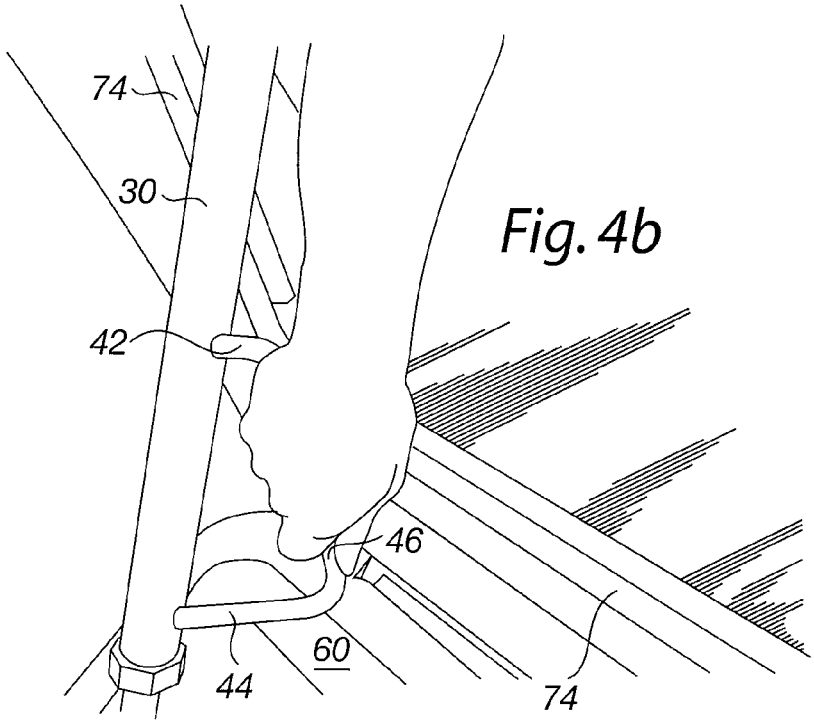
Figure 5A:
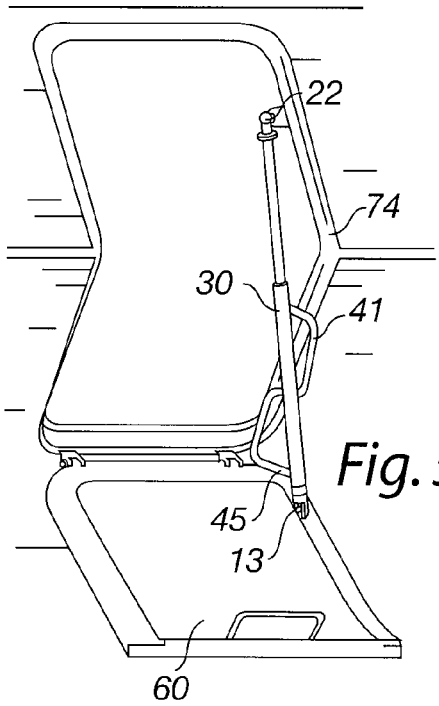
FIG. 5 shows an embodiment of a door equalizer support having two handholds.
Figure 5B:
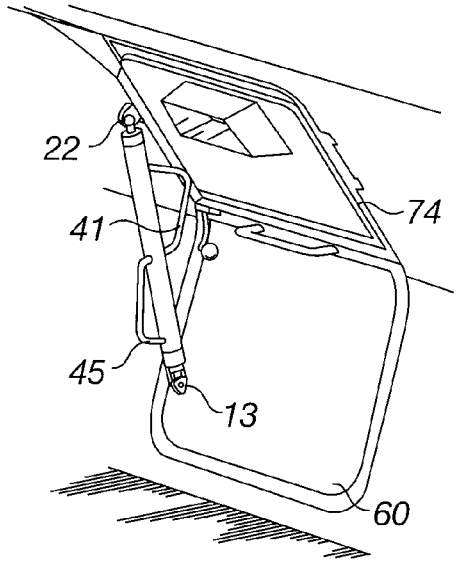
Figure 5C:
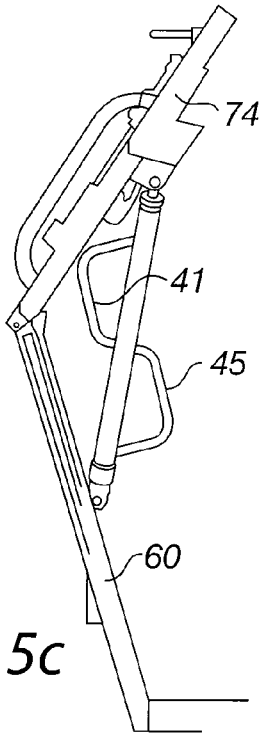
Figure 5D:
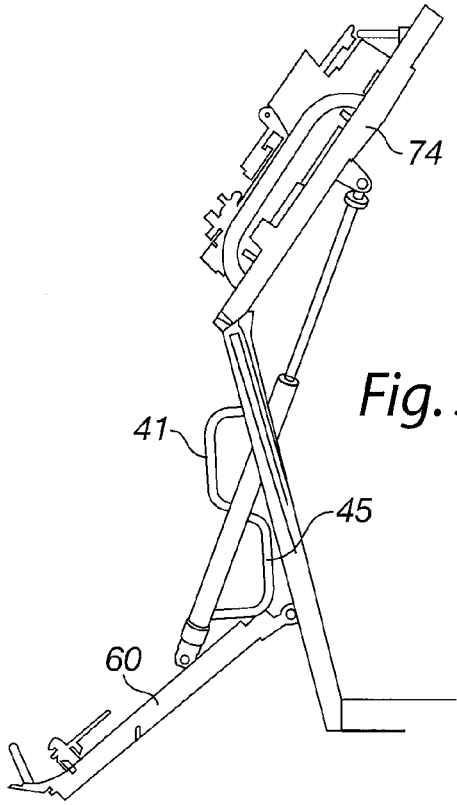

FIGS. 4 and 5 show how the shape of an embodiment of the handlebar (40) (45) supplement this improved efficiency, by providing a translating source of resistance for both horizontal and vertical force. In the embodiment, the low location of the handlebar (40) (45), near the bottom edge of the doorframe (74), facilitates application of upward force against the upper of the two spacing segments (44). Again, in an embodiment with an upward or laterally swinging door, the handlebar (40) (45) would be located adjacent to the doorframe. Horizontal force is facilitated by the large grasping portion (46) that runs vertically, and the handlebar's (40) (45) projection into the interior of the vehicle (70). This facilitation of the door's closure protects the users trying to rapidly close the door in an emergency situation, and makes closure of the door (60) require less energy, which is especially desirable in combat emergency situations with fatigued users.

Figure 6:
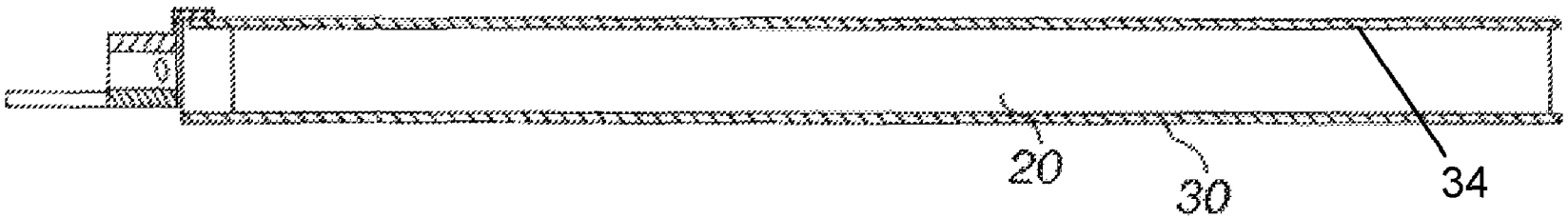
FIG. 6 shows an embodiment of a door equalizer support, focusing on the bushing and low frictional engagement with the actuator's exterior chamber.

FIG. 6 shows a cross section of an embodiment of the support (30) showing the bushing (34) on the interior surface of the support (30). When the piston (10) is collapsed within the exterior chamber (20), the support (30) pivots to the exterior chamber (20) with bushing(s) (34) fixed to the end of the support (30) that travel along the length of the support (30) as it telescopes or collapses. The structure of the bushing (34) and manner of piloting is such that it permits continued smooth sliding motion, with minimal friction between the support (30) and exterior chamber (20), throughout the extension stroke. The bushing (34) remains engaged with the exterior chamber (20) throughout the extension stroke. When the piston (10) is telescoped and is outside of the exterior chamber (20), it is free of the bushing (34) but remains protectively surrounded by the support (30). In that position, the bushing (34) rests at the opposite end of the equalizer (50) from the piston (10). Thus, the bushing (34) permits addition of the structural tubular support (30) to prevent elastic deformation of the exterior column (20), while maintaining smooth stroke as the column (20) telescopes and collapses.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A pneumatic door closing system, said system comprising:

a door of a vehicle mounted to a doorframe of the vehicle;

a pneumatically-powered actuator having a fully extended position and a retracted position, the extended position corresponding to an open door position and the refracted position corresponding to a closed door position, the actuator comprising:

an exterior chamber having a proximal end and a distal end, the proximal end pivotally coupled with an interior of the vehicle, and a piston having a distal portion, a proximal portion and a longitudinal axis extending therebetween, the distal portion being pivotally coupled with the door and the proximal portion being slidably coupled with an inside surface of the exterior chamber such that, when the actuator is in the retracted position, the piston is substantially disposed within the exterior chamber and, when the actuator is in the extended position, the piston is extended along the longitudinal axis substantially outside the exterior chamber;

a support member having a proximal portion and a distal portion, the proximal portion being slidably coupled with an outside surface of the exterior chamber and the distal portion being pivotally coupled with the door, wherein the support member is disposed over the piston and slidably coupled with the outside surface of the exterior chamber throughout the range of motion of the actuator from the retracted position to the fully extended position so as to protect the piston when extended; and a first handle mounted to the support member such that forces applied to the handle are transferred to the support member so as to inhibit distortion of the piston, the handle being configured to facilitate ingress or egress to or from the vehicle, respectively, and to facilitate closing of the door by an occupant from the interior of the vehicle.

2. The door closing system of claim 1, wherein the first handle comprises a grasping portion, wherein the grasping portion is angled relative to the longitudinal axis of the piston such that force applied to the grasping portion is directed along a direction having a substantial component parallel to the longitudinal axis so as to inhibit distortion of the piston by reducing a force component perpendicular to the longitudinal axis.

3. The door closing system of claim 2, wherein the grasping portion is angled such that a distance between the grasping portion and the support member increases distally along the support member so that when a proximal pulling force is applied to the handle by the occupant from the interior of the vehicle, the applied force is directed along the longitudinal axis in a proximal direction to facilitate closing of the door by retraction of the actuator.

4. The door closing system of claim 1, wherein the handle projects outward from the support member towards the interior of the vehicle when the door is in the open position, the actuator being in the extended position, so as to facilitate ingress, egress or closing of the door from within the interior of the vehicle.

5. The door closing system of claim 1 further comprising:

a second handle mounted to the support member adjacent the first handle and configured to facilitate ingress or egress to or from the vehicle, respectively.

6. The door closing system of claim 5, wherein each of the first and second handle are angled relative to the longitudinal axis in opposite directions.

7. The door closing system of claim 5, wherein the first handle is mounted to the support member so as to extend outward in a first direction, and the second handle is mounted to the support member so as to extend outward in a second direction, the second direction being different than the first direction.

8. The door closing system of claim 7, wherein the first and second handles extend outward from the support member in opposing directions.

9. The door closing system of claim 7, wherein the first handle is mounted on the support member in a location proximal of the second handle, wherein, when the door is in the open position, the first handle extends outward towards the interior of the vehicle to facilitate closing of the door with the handle from the interior of the vehicle, and the second handle extends outward away from the interior of the vehicle to facilitate ingress into the vehicle.

10. The door closing system of claim 1, wherein the proximal portion of the support member is slidably coupled over the exterior chamber when the actuator is in the fully extended position, the retracted position, and when extending or retracting between positions.

11. The door closing system of claim 1, wherein the support member is slidably coupled with the exterior chamber with a bushing.

12. The door closing system of claim 11, wherein the bushing remains in contact with the outside surface of the exterior chamber when extending between the retracted position and the fully extended position.

13. The door closing system of claim 1 wherein the door of the vehicle is mounted to the doorframe of the vehicle by a hinge having a substantially horizontal axis of rotation.

14. A pneumatic door closing system, said system comprising:

a door of a vehicle mounted to a doorframe;

a pneumatically-powered actuator having a fully extended position and a retracted position, the extended position corresponding to an open door position and the refracted position corresponding to a closed door position, the actuator comprising:

an exterior chamber having a proximal end and a distal end, the proximal end coupled with the doorframe, and a piston having a distal portion, a proximal portion and a longitudinal axis extending therebetween, the distal portion being coupled with the door and the proximal portion being slidably coupled with an inside surface of the exterior chamber;

a support member having a proximal portion and a distal portion, the proximal portion being slidably coupled with an outside surface of the exterior chamber and the distal portion being pivotally coupled with the door, wherein the support member is disposed over the piston and slidably coupled with the outside surface of the exterior chamber throughout the range of motion of the actuator from the retracted position to the fully extended position so as to protect the piston when extended; and a handle mounted to the support member and configured so as to absorb and transfer forces applied to the handle so as to inhibit distortion of the piston by reducing forces applied perpendicular to the longitudinal axis.

15. The door closing system of claim 14 wherein the support member is slidably coupled to the exterior chamber with a bushing.

16. The door closing system of claim 15 wherein the bushing remains in contact with the outside surface of the exterior chamber when the actuator is in the retracted position, the fully extended position and when traveling therebetween.

* * * * *